US005873652A

United States Patent [19]

Bayer et al.

[11] Patent Number: 5,873,652

[45] Date of Patent: Feb. 23, 1999

[54] CHANDLIER ASSEMBLY AND CHANDELIER COMPONENTS FOR GLASS ARM CONFIGURATIONS

[75] Inventors: Georg Bayer; Andrew M. Schuyler, both of Plattsburgh, N.Y.

[73] Assignee: Schonbek Worldwide Lighting, Inc., Plattsburgh, N.Y.

[21] Appl. No.: 678,193

[22] Filed: Jul. 11, 1996

[51] Int. Cl.[6] ..... F21S 1/06; F21S 1/04

[52] U.S. Cl. ..... 362/405; 362/404; 362/406; 362/806

[58] Field of Search ..... 362/405, 406, 362/806, 404

[56] References Cited

U.S. PATENT DOCUMENTS

| | | | |
|---|---|---|---|
| 922,490 | 5/1909 | Levinson | 362/405 |
| 1,629,489 | 5/1927 | Dvorak | 362/406 |
| 2,197,887 | 4/1940 | Elting | 362/405 |
| 2,278,433 | 4/1942 | Elting | 362/405 |
| 2,279,034 | 4/1942 | Elting | 362/405 |
| 3,387,129 | 6/1968 | Weber et al. | 362/405 |
| 3,621,113 | 11/1971 | Westby | 362/406 |
| 3,622,779 | 11/1971 | Laagin | 362/405 |
| 3,735,123 | 5/1973 | Porter et al. | 362/405 |
| 3,735,329 | 5/1973 | Funabashi et al. | 362/405 |
| 4,034,216 | 7/1977 | Webster et al. | 362/405 |
| 4,079,244 | 3/1978 | Bortoluzzi | 362/405 |
| 4,107,770 | 8/1978 | Weber | 362/405 |

*Primary Examiner*—Sandra L. O'Shea
*Assistant Examiner*—Matthew J. Spark
*Attorney, Agent, or Firm*—Wolf, Greenfield & Sacks P.C.

[57] ABSTRACT

A preformed or preassembled bowl/plate assembly, including a bowl, a plate secured with respect to the bowl and defining with the bowl a chamber, the plate having a number of openings, each configured to receive a chandelier arm in a predetermined array. The chamber houses a plurality of wires with one pair of wires extending through each of the openings in the plate from the chamber. A plate/arm arrangement is provided to permit attachment of chandelier arms to the plate while only having access to the upwardly-facing surface of the plate. The chandelier arms may be both structurally attached to the chandelier framework and electrically attached to the central wiring of the chandelier after preassembly of the bowl/plate arrangement. The chandelier arms are preferably formed in an arcuate shape with a light socket attached to a first end and a sleeve attached to a second end and a pair of wires electrically attached to the light socket. The wires extend from the light socket through the chandelier arm to the second end and attached to a corresponding pair of wires extending from the openings in the plate to form a plurality of wire attachments. Peripherally, each pair of wires extending from the plate openings terminate in a plug positioned outside of the chamber and each pair of wires extending from each chandelier arm terminates in another plug which is configured to meet with the plug emanating from the plate opening.

17 Claims, 7 Drawing Sheets

CHANDLIER ASSEMBLY AND CHANDELIER COMPONENTS FOR GLASS ARM CONFIGURATIONS

FIELD OF THE INVENTION

This invention relates to chandelier assemblies, components thereof and methods for assembling chandeliers. The invention in particular relates to chandeliers having glass arms.

BACKGROUND OF THE INVENTION

Chandeliers come in a variety of forms and are made of a variety of materials. For example, certain chandeliers are made almost entirely of metal whereas other chandeliers are made almost entirely of glass. Chandeliers made primarily of glass present special problems with respect to shipping, particularly if the chandelier includes delicate, arcuate shaped glass arms. An example of such a chandelier is shown in FIG. 1.

The chandelier 10 includes a number of primary components. Its principal framework is a central stem 12 formed of a central metal support rod obscured from view by a series of dishes or bowls 14 and urns 16 stacked vertically upon one another. Crystals 18 are hung from these bowls to further adorn the chandelier. In addition, the chandelier is provided with a plurality of delicate, arcuate glass arms 20, some of which terminate in a light bulb 21. These delicate glass arms 20 are attached typically to a metal plate (not visible) secured to the central metal support rod and obscured from view by being seated within one of the bowls 14. The glass arms 20 thus provide a mechanism for lighting the chandelier and also provide points of attachment for crystals 18 and chains of crystals, which points of attachment are somewhat remote from the central stem, thereby allowing for draping of crystal chains and so forth to provide desirable appearances.

FIG. 2 is a representative partial cross-section of a chandelier of the type described in FIG. 1. The central support rod 22 extends vertically through the chandelier and terminates at its upper end in a ring 24 attached to support rod upper threads 26, to permit the chandelier to be hung from a ceiling. The bottom end of the support rod 22 has support rod lower threads 26'. These lower threads 26' are adapted to receive a pair of threaded nuts 28 which sandwich and hold in place a metal plate 30. The bowls 14', 14" and urns 16 are stacked upon the metal plate 30, with the support rod 22 passing centrally therethrough. The upper most bowl 14' is fixed from detachment from the support rod 22 by a washer 32 held in place by a threaded nut 34 secured to the ring 24 and screwed onto the upper threads 26 of the support rod 22. The bowl 14" is secured to a threaded stem 36 extending from the bottom end of the support rod 22 by a bottom bowl washer 38 and threaded nut 40. The plate 30 is seated within the bowl 14" when the bowl is attached to the threaded stem 36. The plate 30 and metal bowl 31 when assembled define a cavity containing the wiring. This cavity or chamber then is received within the bowl 14" which obscures from view the threaded stem and all of the wiring (not shown) that is connected to the lighted glass arms 20'.

The lighted glass arm 20' is connected to the plate 30 in a conventional manner. Each lighted glass arm 20' is seated in a cup or sleeve 42. Extending from the bottom of the sleeve 42 and threaded through the bottom of the sleeve 42 is a threaded stem 44. (To manufacture the arm, the threaded stem is threaded into the sleeve and the arm is then seated in the sleeve and cemented thereto.) The threaded stem 44 is inserted through a radially disposed opening 46 in the plate 30, with the bottom of the sleeve 42 abutting the upwardly facing surface of the plate 30. A washer 48 and threaded nut 50 are passed over the positive wire 52, negative wire 54 and ground wire 56 extending from the threaded stem 44 and the threaded nut 50 is threaded onto the threaded stem 36, thereby securing the lighted glass arm 20' to the plate 30. The wires 52, 54, 56 then are connected to central wiring passing through the central stem to provide an electrical communication between the light socket 58 and an electrical energy source to which the chandelier is connected.

The wiring is shown in greater detail in FIG. 3. The wires 52, 54, 56 extend from the light socket through lighted glass arm 20', through the radial opening 46 and the plate 30 and out of the threaded stem 44 attached to the lighted glass arm 20'. A positive wire 52 from each of the lighted glass arms 20' (two arms shown) and a positive wire 52' from the wiring extending from the central stem 12 are electrically connected using a first wire nut 60. Likewise, a negative wire 54 from each of the lighted glass arms 20' and a negative wire 54' from the wiring of the central stem are connected to one another by a second wire nut 60. The ground wires (not shown) are secured in the same manner. While only two glass arms are shown in FIG. 3, two glass arms are not typical. Instead, chandeliers more frequently have 5, 10, 20 or even more lighted glass arms attached to a plate. Referring to FIG. 4, approximately 20 lighted glass arms (not shown) are attached to the plate 30. The wiring for 12 of these glass arms is shown. As can be seen, the wiring is complex. It is not permitted to attach more than a certain number of wires through a single wire nut 60'. Therefore the positive wires 52 from some lighted glass arms are connected to one wire nut 60' whereas the positive wires 52 from other glass arms are connected to a different wire nut 60', which in turn is connected sometimes via auxillary wire nuts to the central wiring. Only after all of the wiring has been completed can the bottom bowl 14" and metal bowl 31 be attached to the plate 30 to form a bowl/plate assembly defining a chamber which contains and obscures from view the wiring.

It should be readily understood that the foregoing process for assembling a chandelier imposes a serious burden upon the distributor or ultimate customer. As discussed above, the glass arms 20 are too delicate to preassemble onto the chandelier 10, and, therefore, must be packed and shipped separately. Because access to both sides of the plate 30 are required to mount the glass arms 20 onto the metal plate 30, the bottom bowl 14" and metal bowl 31 cannot be assembled and attached to the metal plate 30 until after assembling the glass arms onto the plate, because doing so would prevent the necessary access to the bottom side of the plate for attachment of the glass arms 20 to the plate 30. Likewise, because the glass arms 20 are packed separately, the chandelier cannot be prewired for easy assembly.

Disassembly can be as substantial a problem as assembly, should part of the wiring fail or should any one of the arms be damaged. In order to repair a glass arm, or even test the wiring in a glass arm, the bottom bowl 14" and metal bowl 31 must be disassembled from the bowl/plate assembly to expose the wires so that the wires from the damaged or failing arm can be physically detached from the other wires and also so as to provide access to the nut abutting the bottom surface of the plate and holding the glass arm to the plate.

It thus would be desirable to have a chandelier assembly that is easier to put together and take apart, but that still permits shipping of arms, and in particular glass arms, separately packaged.

SUMMARY OF THE INVENTION

The invention permits arms to be attached to (and detached from) a preassembled bowl/plate arrangement. The arms can be both structurally attached to the chandelier framework and electrically attached to the central wiring of the chandelier after preassembly of the bowl/plate arrangement. A bowl/plate assembly is preformed with wires accessible for electrical attachment to the arms. A plate/arm arrangement is provided to permit attachment of the arm to the plate while only having access to the upwardly facing surface of the plate. In this manner, the chandelier components may be shipped as a plate/bowl assembly and glass arms, with the customer having only to quickly and easily attach the arms to the plate/bowl assembly.

According to one aspect of the invention, a method for assembling a chandelier is provided. The invention involves first providing a bowl, a plate secured with respect to the bowl and defining with the bowl a chamber, the plate having a plurality of first openings, each first opening for receiving a chandelier arm in a predetermined array, and a plurality of wires, one pair of wires extending through each of the first openings from the chamber. This aspect of the invention also involves providing a plurality of chandelier arms preferably formed in an arcuate shape, each arm having a first end and a second end, a light socket attached to the first end, a sleeve attached to the second end and a pair of wires electrically attached to the light socket. The wires extend from the light socket through the arm to the second end. Once these elements have been provided, each pair of wires of each chandelier arm is attached to a corresponding pair of wires extending from the first openings of the plate, thereby forming a plurality of wire attachments. The wire attachments then are placed through the first openings, and then the chandelier arms are attached to the plate. In an important aspect of the invention, each pair of wires extending from the first openings terminates at a first plug positioned outside of the chamber, and each pair of wires extending from each arm terminates in a second plug mating with the first plug, wherein the attaching step is carried out by joining the first plug with the second plug. The foregoing method is particularly suited to glass chandelier arrangements involving glass ornamental bowls and lighted glass chandelier arms. In one important embodiment the glass arm has attached to it a flange, and the chandelier arm is secured to the plate by a plurality of screws engaging threaded openings in the plate, at least one screw for and engaging a corresponding flange on each chandelier arm to secure the chandelier arm to the plate.

According to another aspect of the invention, a chandelier component is provided. The chandelier component includes a bowl and a plate secured with respect to the bowl and defining with the bowl a chamber. The plate has a plurality of first openings, each first opening for receiving a chandelier arm in a predetermined array. The component also includes a plurality of wires, one pair of wires extending through each of the first openings from the chamber for electrical attachment to a light fixture on the chandelier arm. Preferably the bowl/plate assembly is attached to a support rod which together with the plate and bowl form a central chandelier stem. In one embodiment the bowl/plate assembly is received in an ornamental glass bowl and each pair of wires terminates in a plug disposed outside of the chamber, the plugs constructed and arranged to fit through the first openings. The plate can be of any suitable material, although preferably the plate is metal. The chandelier component can further comprise means for attaching the chandelier arms to the plate. These means may be separate from the plate or may be part of the plate. Just as a preferred example, the plate can include a plurality of threaded openings, preferably wherein each first opening has one of said plurality of threaded openings positioned adjacent thereto.

According to still another aspect of the invention, another chandelier component for assembling into a chandelier is provided. This component is a glass arm, preferably formed in an arcuate shape, and having a first end and a second end. A light socket is attached to the first end and a sleeve is attached to the second end. A pair of wires are electrically attached to the light socket, extend through the glass arm and terminate in a plug. The arm includes a flange at the second end, the flange defining an opening for attaching the arm to a chandelier framework. In a preferred embodiment, the component further comprises a ground wire attached to a first metal stem at a first end of the arm and attached to a second metal stem at the second end of the arm.

According to yet another aspect of the invention, a chandelier component for assembling into a chandelier is provided. This component is a glass arm, preferably formed in an arcuate shape, and having a first and a second end. A light socket is attached to the first end, and a sleeve is attached to the second end. A pair of wires are electrically attached to the light socket, extend through the glass arm and terminate in a plug. A ground wire is attached to a first metal stem at the first end of the glass arm and is attached to a second metal stem at the second end of the glass arm.

Still another aspect of the invention is a chandelier. The chandelier includes a bowl, a plate attached to the bowl and defining with the bowl a chamber, a plurality of glass arms attached to the plate and a plurality of wires. One pair of wires is present for each arm, each pair of wires extending from the chamber through openings in the plate and into a corresponding arm to a light socket at the end of the arm. Each pair of wires is interrupted by a pair of mating plugs disposed in the chamber, and the pairs of mating plugs are constructed and arranged to fit through the openings. Preferably the arms are detachably secured to the plate when the plate is attached to the bowl. Each arm can be attached to the plate by a flange secured at one end of each arm, the flange including a flange opening which preferably is aligned with a threaded opening in the plate. The bowl/plate assembly can be received in a glass ornamental bowl.

These and other aspects of the invention will be described in greater detail below with respect to the drawings.

DETAILED DESCRIPTION OF THE INVENTION

The invention involves a plate/arm arrangement provided to permit attachment of an arm to the plate while having access only to the upwardly facing surface of the plate. It also involves a preassembled bowl/plate arrangement, whereby the arms can be structurally attached to the bowl/plate arrangement and electrically attached to central wiring contained within the bowl/plate arrangement, without separating the bowl from the plate.

Figure 1:
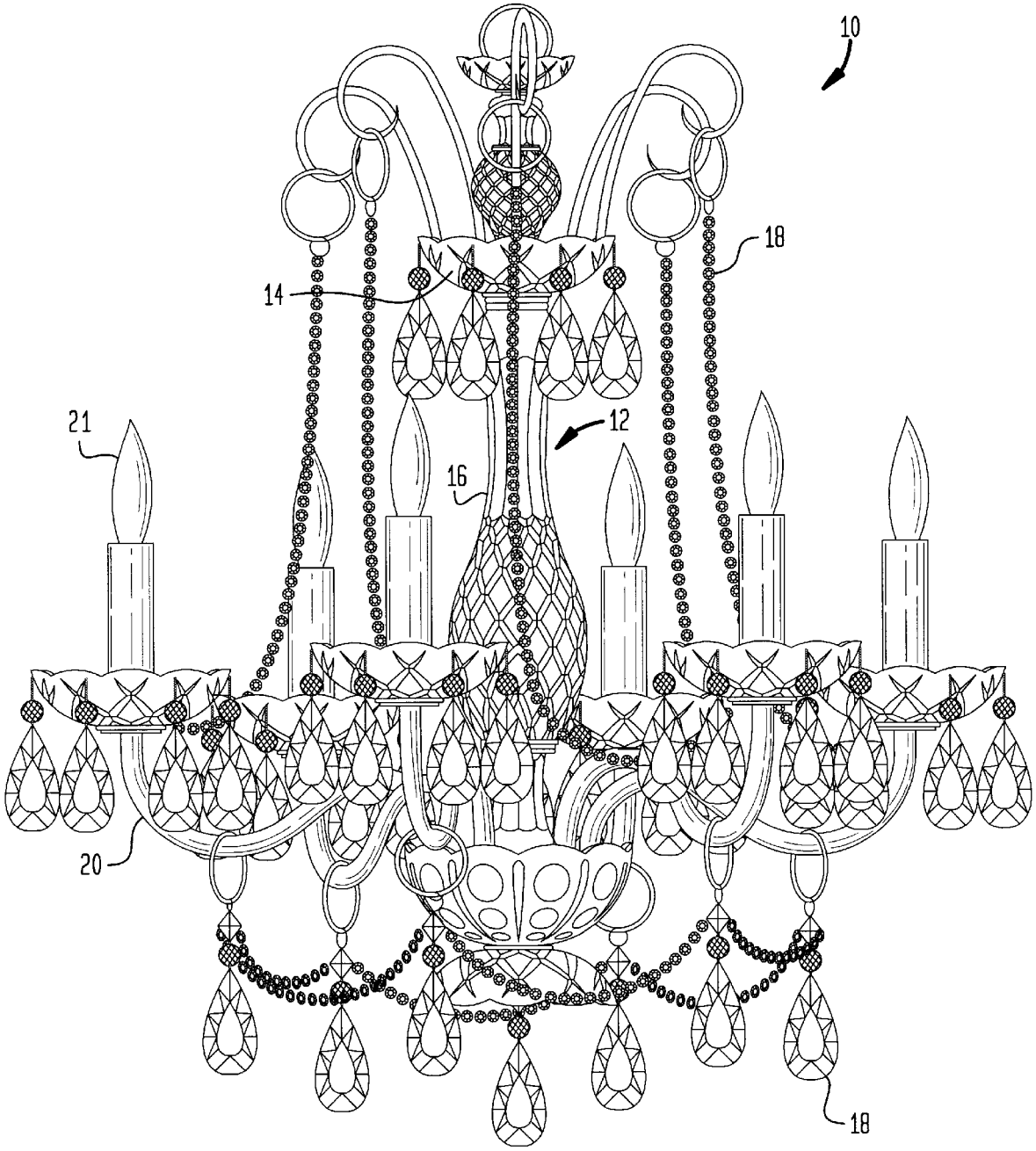
FIG. 1 (PRIOR ART)
FIG. 1 is a prior art glass chandelier assembly of the type to which the present invention can pertain.
Figure 2:
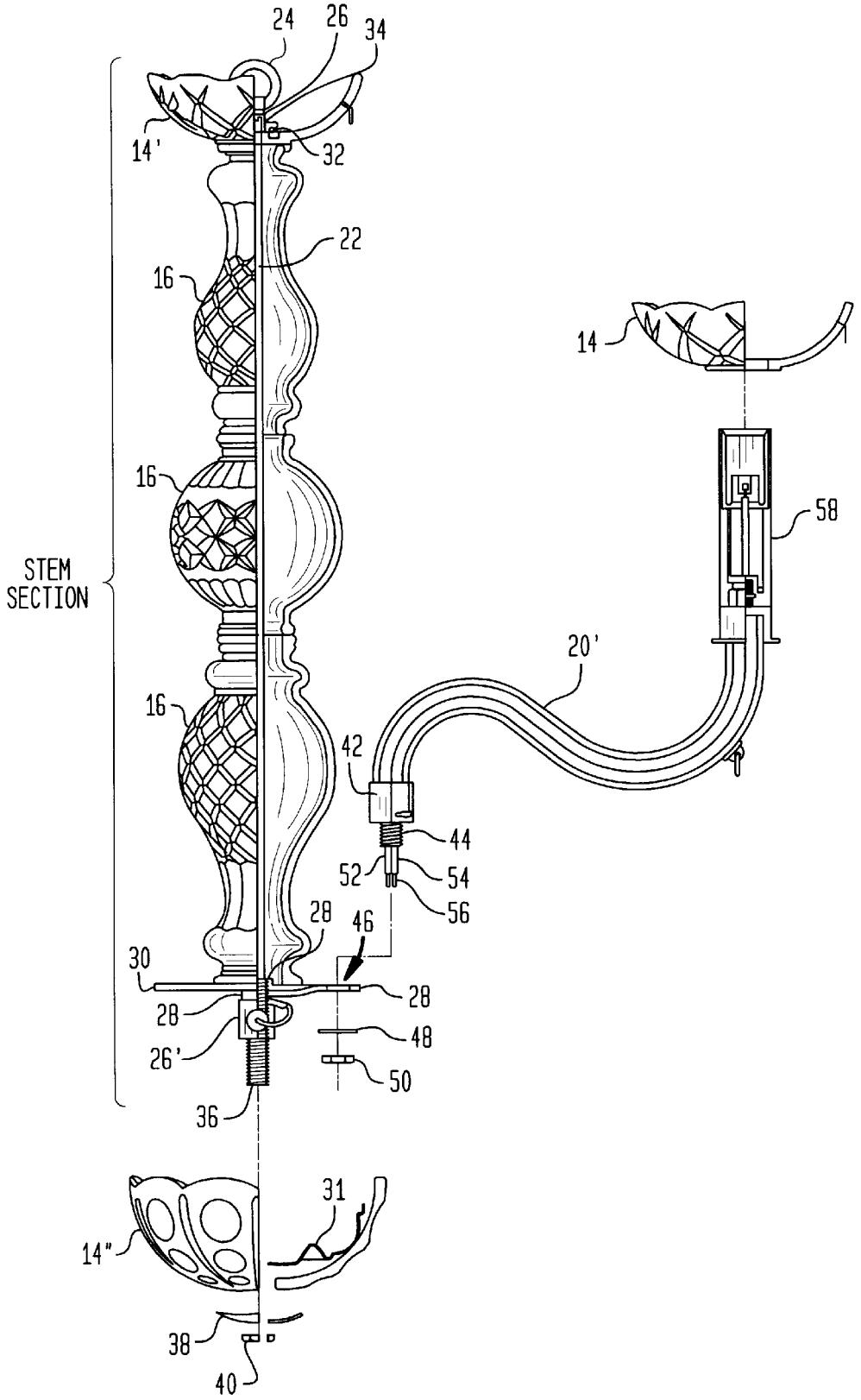
FIG. 2 (PRIOR ART)
FIG. 2 is a partial cross-section and partial exploded view of a prior art chandelier of the type shown in FIG. 1.
Figure 3:
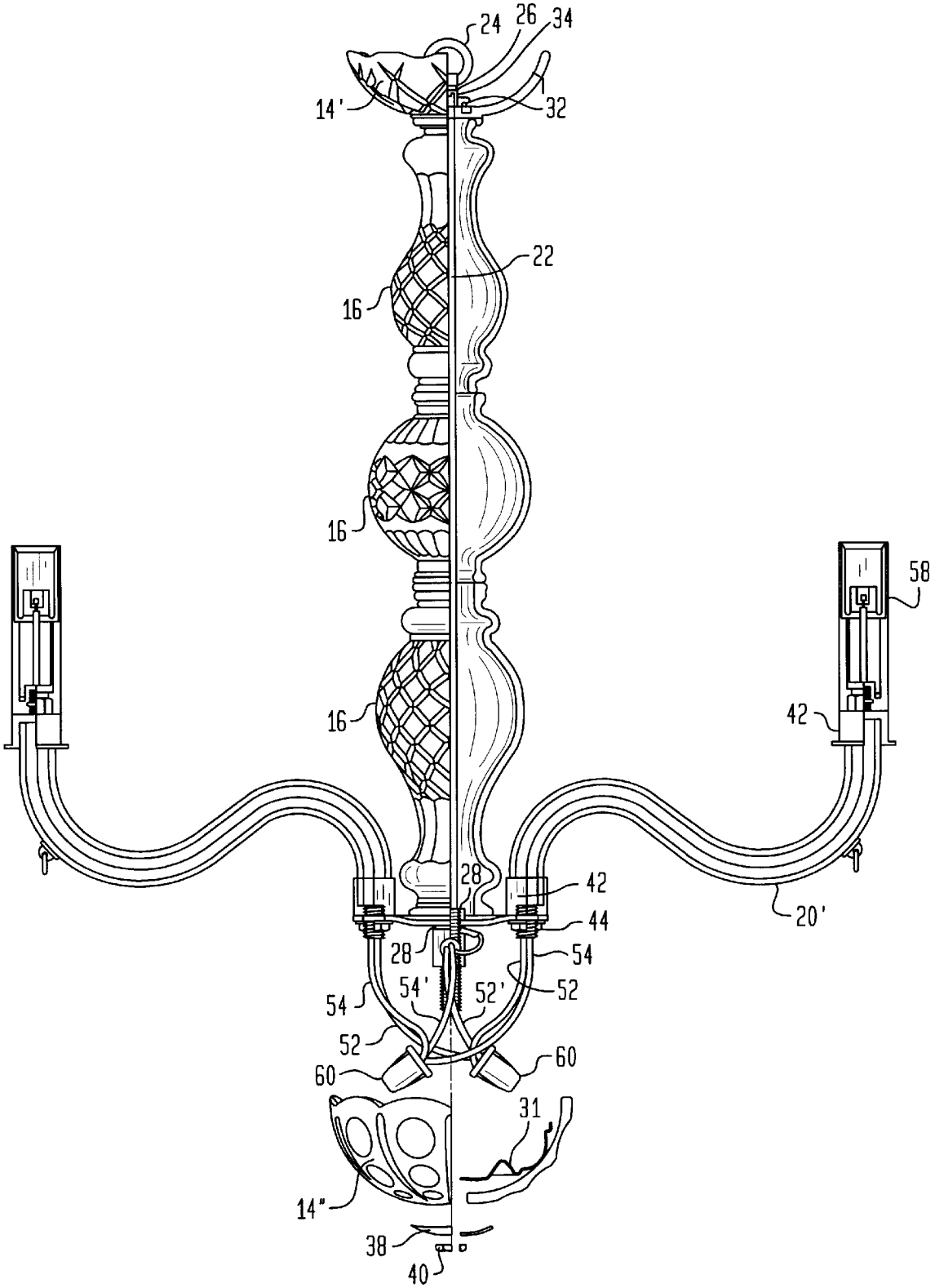
FIG. 3 (PRIOR ART)
FIG. 3 is another partial cross-section and partial exploded view of a prior art chandelier of the type depicted in FIG. 1.
Figure 4:
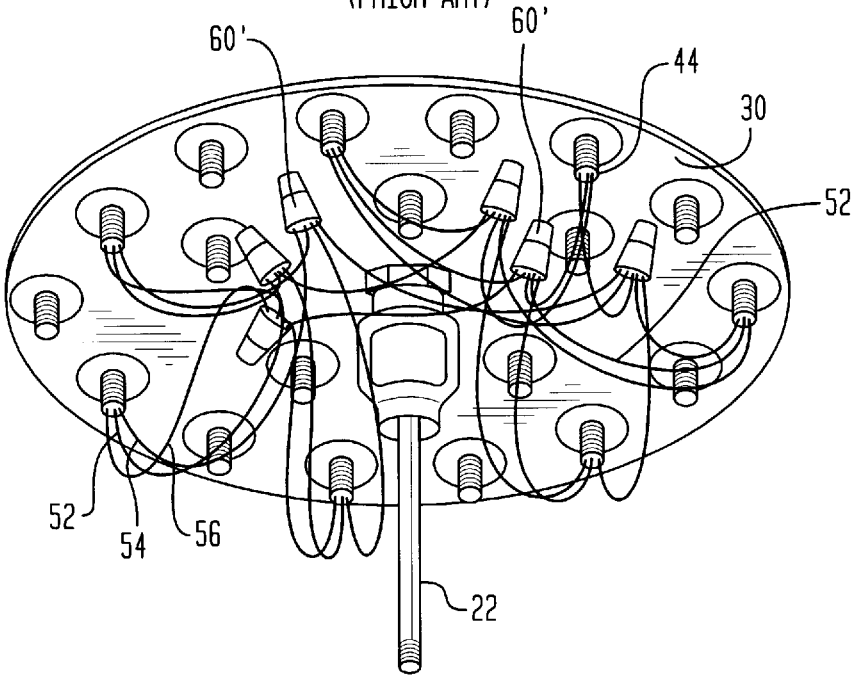
FIG. 4 (PRIOR ART)
FIG. 4 is a bottom perspective view of a plate of a prior art chandelier of the type depicted in FIG. 1, with attached arms and wired electrically.
Figure 5:
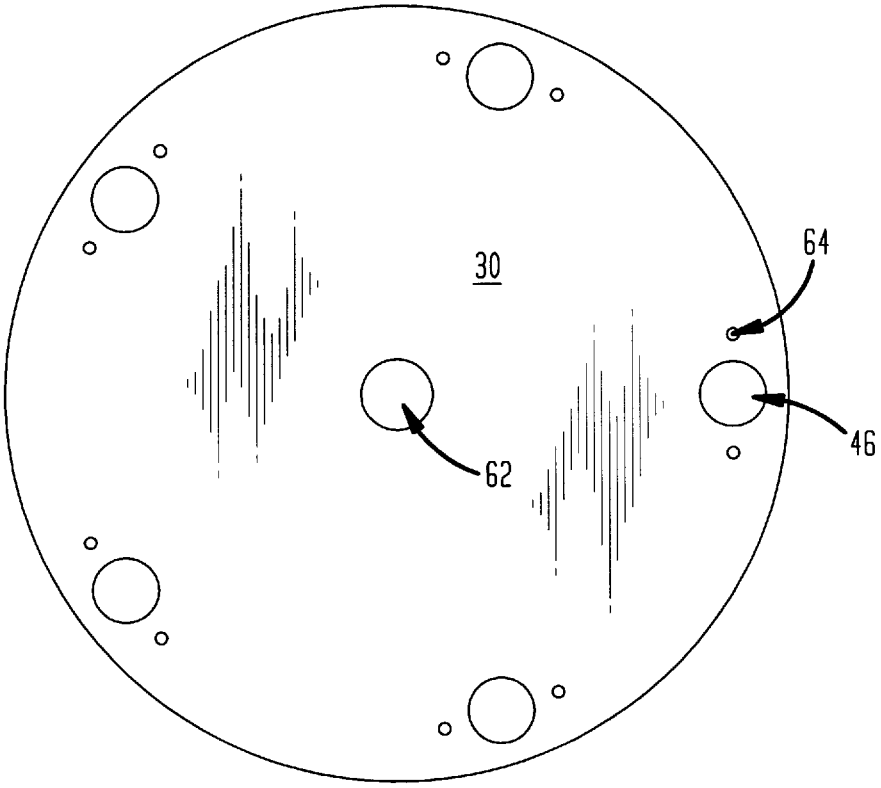
FIG. 5 is a top view of a plate useful in the bowl/plate assembly of the invention.
Figure 7:
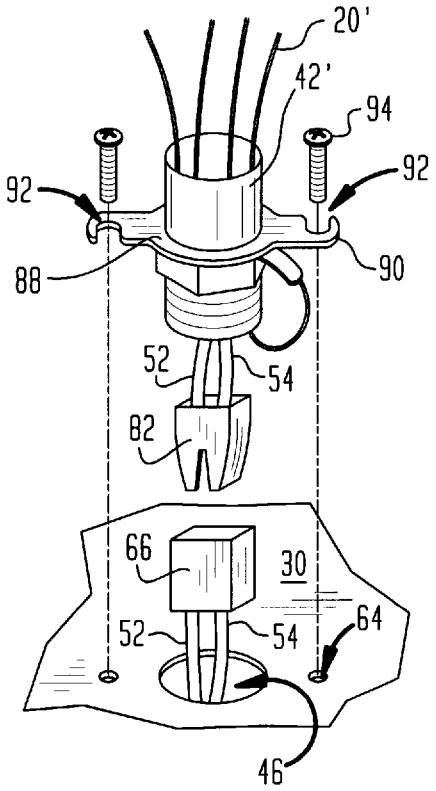
FIG. 7 is an exploded perspective view of the region bounded by lines 7A in FIG. 6.

The plate is shown in FIG. 5. The metal plate 30 has a central opening 62 adapted to receive a central support rod (not shown) for mounting the plate upon the central support rod. The plate 30 also has radially disposed unthreaded openings 46 disposed in the predetermined array, each opening 46 for receiving a glass chandelier arm. On either side of and adjacent to each opening 46 is a smaller threaded opening 64. These threaded openings 64 are for receiving screws 94 (FIG. 7).

Figure 6:
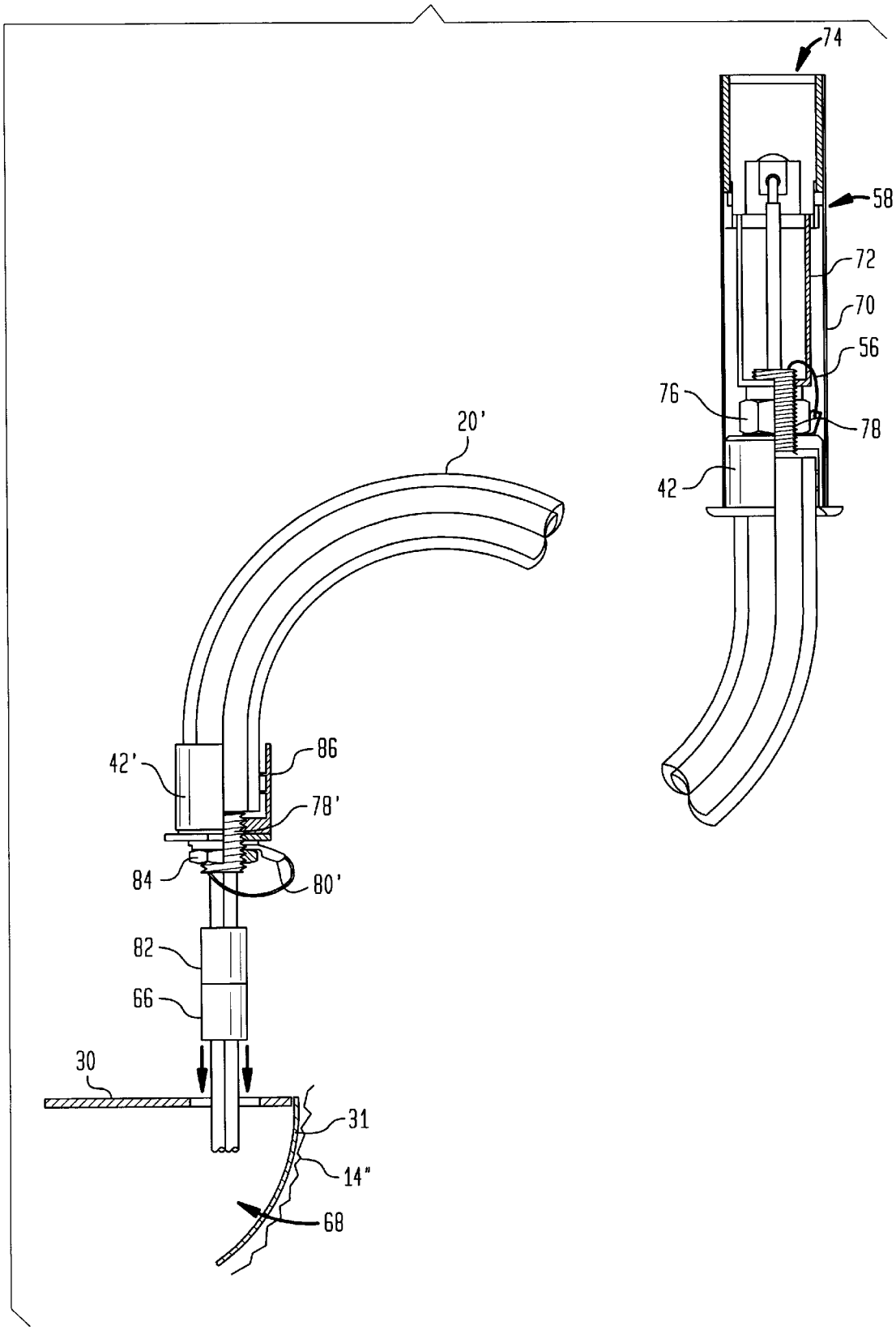
FIG. 6 is a partial cross-section of a lighted glass arm electrically attached to the bowl/plate assembly of the invention, but prior to attaching the arm to the plate.

In the chandelier component that is the bowl/plate assembly, each opening 46 has extending through it a pair of wires 52, 54 terminating in a female plug 66 (FIG. 6). The wires 52, 54 extend from the female plug 66 through the opening 46 and are attached to other wires (not shown) in the chamber 68 defined by the plate 30 and bowl 31. Thus, it can be understood that the bowl 31 and bowl 14" can be assembled onto the central stem and attached indirectly to the plate 30 prior to the attachment of the lighted glass arm 20, structurally or electrically, to the chandelier. Instead, the wiring beneath the plate 30 first is completed, with the plurality of female plugs 66, one each for attachment to each lighted arm, fed through each of the radially disposed openings 46 in the plate, and the bowls 31, 14" then are attached to the plate 30 for shipment as part of the preassembled central stem.

A lighted glass arm according to the invention also is shown in FIG. 6. At one end of the lighted glass arm is a light socket 58 conventionally constructed. It includes a cover 70 and an inner framework 72 terminating in a conventional light bulb socket 74. The framework 72 includes a threaded nut 76, which is secured to a threaded stem 78 extending from the upper end of the lighted glass arm 20. A first grounding tab is secured between the metal sleeve 42 at the upper end of the arm and the threaded nut 76 of the framework 72 of the light socket 58. The ground wire 56, together with the wires 52, 54, extends through the glass arm and out of the bottom end 86 of the lighted glass arm 20'. The wires 52, 54, terminate in a male plug 82. The ground wire terminates in a second grounding tab 80' which is secured between a threaded nut 84 and the sleeve 42' located at the bottom end 86 of the lighted glass arm 20. The threaded nut 84 is threaded onto a threaded stem 78' at this end of the glass arm 20' to capture the second grounding tab 80' between the threaded nut 84 and the sleeve 42'.

Before attaching the glass arm to the plate, however, the male plug 82 is inserted into the female plug 66, and the mated plugs are passed through the plate openings 46 and into the chamber 68.

The bottom end 86 of the lighted glass arm 20' is shown in perspective view in FIG. 7, positioned above the bowl/plate assembly and ready for electrical and structural interengagement with the bowl/plate assembly. Sandwiched between the threaded nut 84 and the sleeve 42 at the bottom end 86 of lighted glass arm 20' is a flange 88 extending radially outwardly from the sleeve. The flange has two opposing flange extensions 90, each flange extension constructed and arranged to define a flange opening 92 through which a screw 94 may pass. The flange openings 92 also are constructed and arranged so as to be positioned coaxially with the threaded openings 64 in the plate 30 when the lighted glass arm 20' is inserted into the radially disposed openings 46 of the plate 30. In this manner, the threaded portion of screws 94 can pass through the flange openings 92 and into the threaded openings 64 of the plate 30, whereby the heads of the screws engage the flange extensions 90 and secure the lighted glass arm 20' to the plate 30.

Figure 8:
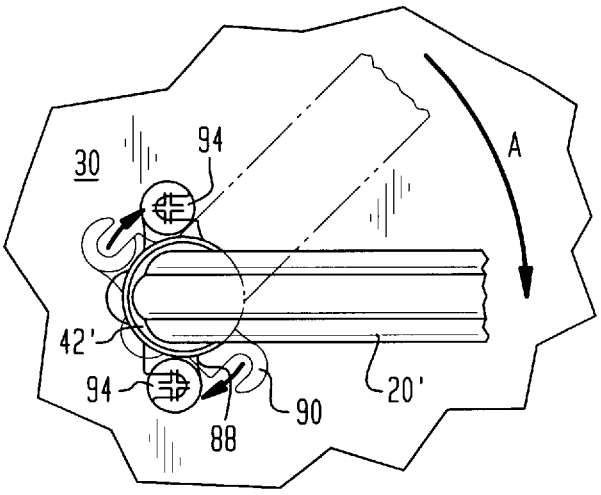
FIG. 8 is a top view of a lighted glass arm assembled onto a plate according to the invention, with a step in the assembly process shown in phantom.

As will be seen from FIG. 8, the screws 94 may be preassembled onto the plate 30 by threading them only partially into threaded openings 64. The bottom end of the lighted glass arm 20' then may be inserted into the plate opening 46, with the glass arm rotated such that the flange extensions 90 do not contact the screws 94 and whereby the flange 88 comes to rest on the upwardly facing surface of the plate 30 (phantom position in FIG. 8). The lighted glass arm 20' then may be rotated (arrow A) until the threaded portion of the screws 94 come to rest within the flange openings 92. The screws then are tightened onto the plate to secure the glass arm onto the plate.

The foregoing arrangement not only provides a mechanism for quickly and simply securing the glass arm to the plate, but also provides a mechanism for orienting the glass arms radially with respect to the center axis of the chandelier. The threaded portions of the screws together with flange extensions 90 act as stops for aligning the radial orientation of the glass arms when the device is assembled.

Figure 9:
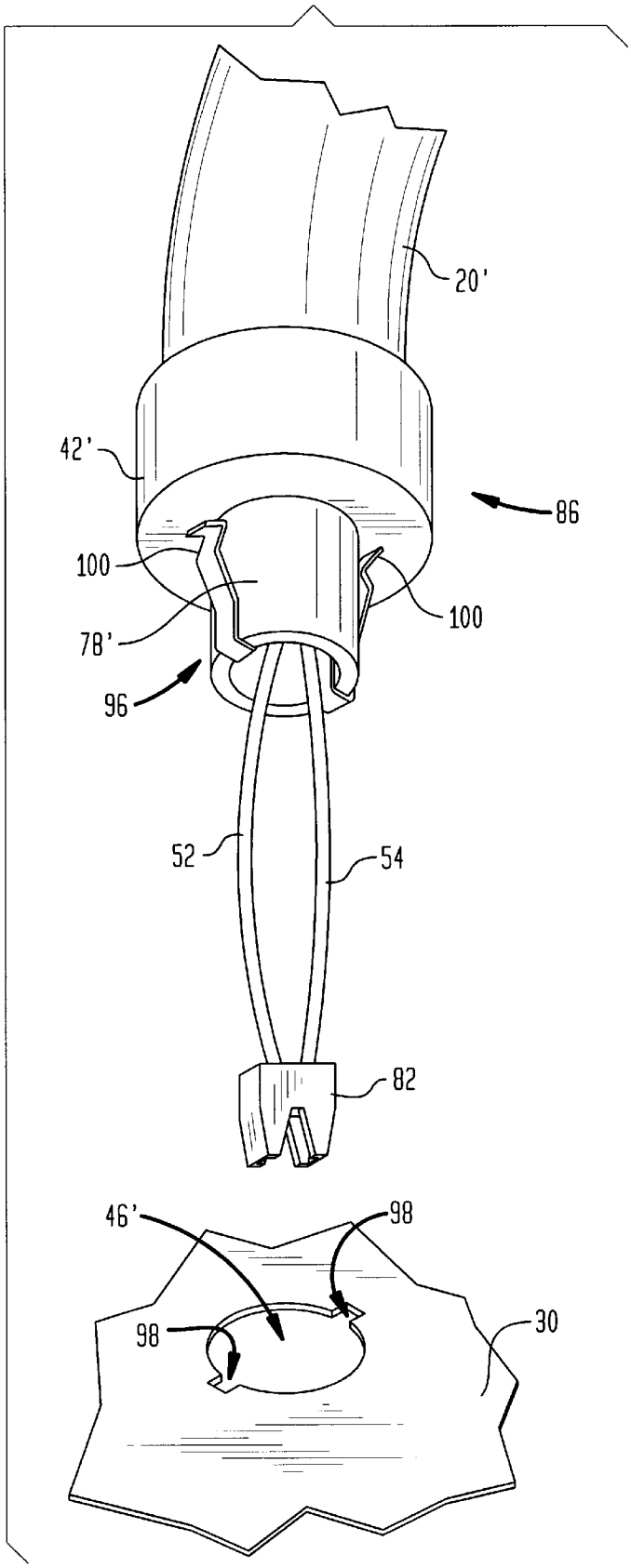
FIG. 9 is a perspective view of a second embodiment for attaching the glass arm to the bowl/plate assembly according to the invention.

FIG. 9 illustrates another mechanism for attaching the glass arm to the preassembled bowl/plate assembly (after the plate and bowl have been assembled as part of the chandelier central stem). In this embodiment, a spring clip 96 is attached to the threaded stem 78' extending from the sleeve 42' at the bottom end 86 of the lighted glass arm. As above, the male plug 82 attached to wires 52, 54, extending from the lighted glass arm first would be attached to the female plug extending from the bowl/plate assembly. The mated plugs then would be passed from outside of the chamber through the plate openings 46 and into the chamber 68, and the glass arm then would be inserted into the opening 46. In this embodiment, the opening 46' preferably is provided with slots 98 for mating with the spring-clip 96. The lighted glass arm 20' is oriented so that the slots 98 receives the arms 100 of the spring-clip 96, and the glass arm simply is forced into the opening 46' against the resistance of the spring-clip in a conventional manner. The spring-clip then secures the lighted glass arm 20' to the plate 30.

It is pointed out that in the preferred arrangement, the need for ground wires in the chamber is substantially avoided. The second ground tab 80' at the bottom end 86 of the lighted glass arm 20' is electrically continuous with the flange, which in turn is in electrical contact with the plate 30 when the glass arm 20 is secured to the plate 30. The plate 30, in turn, may be grounded to the ground wire of the central wiring passing through the central stem. In this manner, many wires within the wiring compartment may be avoided, and the wiring compartment may be more compact. Likewise, the manufacture and assembly is made more simple.

It will be understood that the foregoing embodiments represent only examples of the invention, and it is not intended that the invention be limited thereby. For example, various methods and structures can be used to secure the glass arms 20 to the plate 30. For example, the flange 88 may include openings that are through-holes, whereby the screws 94 cannot be assembled onto the plate 30 in advance of positioning the glass arm appropriately upon the plate. In this instance, the glass arms 20 would be inserted into the openings 46 and the through holes of the flange then would be positioned over the threaded openings of the plate. Then the screws would be inserted through the through-hole of the flange and into the threaded opening of the plate to secure the arms to the plate. As another example, the screws 94 need not contact the arms directly. Instead, the screws could pass through a second plate which would sandwich the flange between the plate 30 and the second plate to secure the glass arms to the plate 30. Plate arrangements of this type are disclosed in U.S. Pat. No. 5, 255,173, and could be adapted to the glass arms of the present invention, particularly if the configuration of the sleeves of the glass arms of the present invention were altered. The disclosure of U.S. Pat. No. 5,255,173 is incorporated herein in its entirety by reference. As another example, the plate 30 need not have threaded holes for securing the glass arm to the plates. The plate 30 instead could include upwardly extending posts which could pass through, for example, a flange on the glass arm to properly position the glass arm on the plate. The post also could be threaded, and a nut could be threaded onto the post to capture the flange between the upwardly facing surface of the plate and the nut. Likewise, the materials of the chandelier may be any of those useful in the chandelier arts. For example, plate 30 preferably is metal, although it could be manufactured of plastic, stone, wood or even glass. The materials simply must be strong enough to perform their intended function. Preferred materials are as indicated above. Preferred plugs are "Mate'n Lock" connectors from Amp Incorporated of Harrisburg, Pa.

Numerous modifications and equivalents will be readily apparent to those of ordinary skill in the art.

We claim:

1. A method of assembling a chandelier comprising:

providing a preassembled bowl assembly comprising a plate secured to a bowl and defining with said bowl a chamber, said plate having a plurality of openings, each opening adapted to receive a chandelier arm in a predetermined array, and a plurality of wires, one pair of wires extending through each of said openings from said chamber, each pair of wires terminating in a first electrical connector positioned outside of said chamber, providing a plurality of chandelier arms, each arm having a first end and a second end, a light socket attached to said first end, and a pair of wires electrically attached to said light socket, passing through said arm to extend from said second end and terminate in a second electrical connector, mating said second electrical connector terminating each pair of wires of each chandelier arm to a first electrical connector terminating a corresponding pair of wires extending from said first openings, thereby forming a plurality of wire attachments, placing each of said plurality of wire attachments through one of said plurality of first openings, and attaching said chandelier arms to said plate.

2. The method of claim 1, further comprising a step of:

attaching a glass ornamental bowl to said preassembled bowl assembly so as to receive said bowl of said preassembled bowl assembly and wherein said chandelier arms comprise glass.

3. The method of claim 1 wherein each arm has attached to said second end a sleeve constructed and arranged to be detachably secured to one of said openings in said plate.

4. The method of claim 3 wherein said sleeve is secured to a flange and wherein said chandelier arms are secured to said plate by one or more screws engaging threaded openings in said plate, at least one screw engaging a corresponding flange on each chandelier arm to secure the chandelier arm to said plate.

5. The method of claim 4 wherein said plate is a metal plate.

6. A preassembled chandelier component comprising:

a bowl, a plate attached to said bowl and defining with said bowl a chamber, said plate having a plurality of openings, each opening for receiving a chandelier arm in a predetermined array, and a plurality of pairs of wires each extending through a respective one of said openings from said chamber terminating at an electrical connector disposed outside of said chamber, said electrical connector constructed and arranged to fit through a corresponding one of said openings for attachment to a mating connector on said chandelier arm, wherein said bowl, said plate and said plurality of wires form the preassembled chandelier component configured such that each said chandelier arm may be structurally attached to said plate and electrically attached to said electrical connector terminating said plurality of wires by accessing only an upwardly facing surface of said plate.

7. The preassembled chandelier component of claim 6 further comprising a glass ornamental bowl receiving said bowl.

8. The preassembled chandelier component of claims 6 or 7 wherein said plate is a metal plate and further comprising mechanical fastener attachment means for attaching said chandelier arms to said plate.

9. The preassembled chandelier component of claims 6 or 7 further comprising mechanical fastener attachment means on said plate for attaching said chandelier arms to said plate.

10. The preassembled chandelier component of claims 6 or 7 further comprising a plurality of threaded openings in said plate.

11. The preassembled chandelier component of claim 10 wherein each of said plurality of openings has one of said plurality of threaded openings positioned adjacent thereto.

12. A chandelier component for assembly into a chandelier comprising:

a glass arm having a first end and a second end, a light socket having a conductive framework attached to said first end, a sleeve attached to said second end, a pair of wires electrically attached to said light socket, extending through said glass arm and terminating in an electrical connector plug proximate said second end, a first grounding tab conductively secured to said sleeve and said conductive framework of said light socket, a second grounding tab conductively coupled to said first ground tab and adapted to be conductively coupled to a metal plate when said chandelier component is connected into the chandelier, and a ground wire conductively coupled to said first and second grounding tabs.

13. The chandelier component of claim 12 further comprising:

a flange at said second end, said flange defining an opening for attaching said arm to a chandelier framework.

14. A chandelier comprising:

a plurality of chandelier arms wherein each of the arms comprises;

(a) a glass arm having a first end and a second end, (b) a light socket having a conductive framework attached to said first end, (c) a pair of wires electrically attached to said light socket, extending through said glass arm and terminating in a first electrical connector plug proximate said second end;

a preassembled bowl assembly consisting of;

(a) a bowl, (b) a plate with a plurality of openings, said plate secured to said bowl thereby defining a chamber, (c) a plurality of wires, one pair of wires for each chandelier arm, wherein each pair of wires terminates at a second electrical connector plug within said chamber each said plug adapted to fit through a corresponding one of said openings;

wherein said first electrical connector is mated with said second electrical connector, said mated connectors disposed in said chamber; and wherein each said chandelier arm is secured to said plate through a respective one of said openings.

15. The chandelier of claim 14 wherein each of said chandelier arms is detachably secured to said plate.

16. The chandelier of claim 15 wherein each chandelier arm is attached to said plate by a flange secured at one end of each chandelier arm, said flange including a flange opening which is aligned with a threaded opening in said plate.

17. The chandelier of claim 15 further comprising:

a glass ornamental bowl attached to said preassembled bowl assembly.

* * * * *